US006743155B2

(12) United States Patent
Pan

(10) Patent No.: US 6,743,155 B2
(45) Date of Patent: Jun. 1, 2004

(54) ANGLE-ADJUSTING DEVICE FOR A TREADMILL FRAME

(75) Inventor: Francis Pan, Taichung Hsien (TW)

(73) Assignee: Forhouse Corporation, Taichung Hsien (TW)

( * ) Notice: Subject to any disclaimer, the term of this patent is extended or adjusted under 35 U.S.C. 154(b) by 79 days.

(21) Appl. No.: 10/139,902

(22) Filed: May 7, 2002

(65) Prior Publication Data

US 2003/0027691 A1 Feb. 6, 2003

(30) Foreign Application Priority Data

Jul. 31, 2001 (TW) ..... 90212859 U

(51) Int. Cl.[7] ..... A63B 22/00
(52) U.S. Cl. ..... 482/54; 482/51

(58) Field of Search ..... 482/51, 54

(56) References Cited

U.S. PATENT DOCUMENTS 6,171,216 B1 * 1/2001 Wang et al. ..... 482/54

* cited by examiner

*Primary Examiner*—Glenn E. Richman
(74) *Attorney, Agent, or Firm*—Head, Johnson & Kachigian

(57) ABSTRACT

An angle-adjusting device for a treadmill is composed of two attachment blocks (11) respectively secured at a certain position at two sides of the belt frame of the treadmill and two polygonal feet (20) corresponding to the attachment blocks (11). Each polygonal foot (20) is rotatably attached to the attachment block (11) and directly engages the attachment block (11). Therefore, the belt frame (10) is immovably combined with the polygonal feet (20) to ensure the treadmill has less vibration during operation.

8 Claims, 6 Drawing Sheets

ANGLE-ADJUSTING DEVICE FOR A TREADMILL FRAME

BACKGROUND OF THE INVENTION

1. Field of the Invention

The present invention relates to an angle-adjusting device for a treadmill frame, and more particularly to an angle-adjusting device that makes the treadmill stable and vibrate less during operation.

2. Description of Related Art

With reference to FIG. 6, a conventional angle-adjusting device (50) for a treadmill frame in accordance with the prior art is adapted to be secured under the rear end of a treadmill. The treadmill (40) includes a front supporting lever (41), an erect handgrip frame (42), a belt frame (43), a traveling belt (45) and the angle adjusting device (50). The angle-adjusting device (50) is composed of a pair of polygonal feet (51) respectively mounted on opposite sides of the bottom of the rear portion of the belt frame (43). The polygonal feet (51) are triangular. The polygonal feet (51) are respectively rotatably mounted on opposite ends of a connecting rod (46).

Each polygonal foot (51) has multiple ground contact edges (not numbered), and each edge is a different length from the other edges so when any ground contact edge of the polygonal plate (51) contacts the ground, the sloping angle of the belt frame (43) is changed. Furthermore, changing the sloping angle of the belt frame (43) only requires raising the belt frame (43) to allow the ground contact edge of each polygonal plate (51) to be lifted clear of the ground. Thereafter, the two polygonal feet (51) are rotated on the connecting rod (46) to permit another ground contact edge to be parallel to the ground. Since the ground contact edge of the polygonal plate is changed, the sloping angle of the belt frame (43) can be easily changed to meet different requirements.

However, the conventional angle-adjusting device (50) is not directly secured on the belt frame (43), and a "linkage," as show in FIG. 7, is formed between the angle-adjusting device (50) and the belt frame (43) in mechanics. The treadmill having a conventional angle-adjusting device (50) constitutes three links of a quaternary link, wherein the four links of the quaternary link are the angle adjusting device (50), the belt frame (43), the front supporting lever (41), and the ground. Stability of this linkage can be estimated by the Kutzbach formula:

$$F=3(N-1)-2P$$

Wherein F is the degree of freedom of the kinematic chain;

N is the number of links; and

P is the number of pairs of elements.

Where N=4 and P=4 for the conventional quaternary link, F is 1. When F is positive, the kinetic chain being analyzed is under-constrained (i.e. moveable) according to the Kutzbach formula. Since F is positive for this quaternary link, the treadmill is unstable and will vibrate when someone steps or runs on the structure.

The present invention has arisen to mitigate and/or obviate the disadvantages of the conventional angle-adjusting device.

SUMMARY OF THE INVENTION

A main objective of the angle-adjusting device in accordance with the present invention is to make the treadmill stable during operation.

Further benefits and advantages of the present invention will become apparent after a careful reading of the detailed description with appropriate reference to the accompanying drawings.

DETAILED DESCRIPTION OF THE INVENTION

Figure 1:
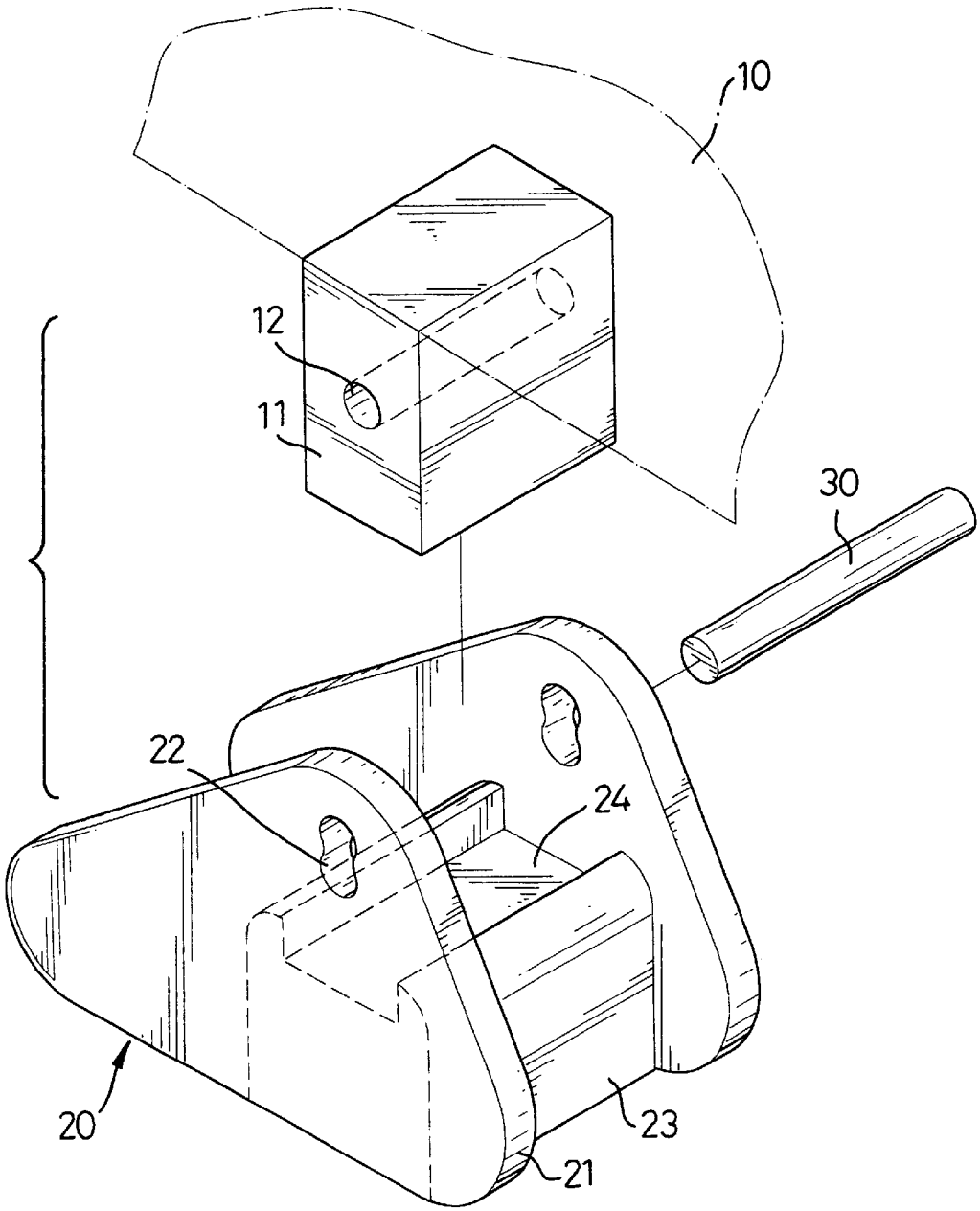
FIG. 1 is an exploded perspective view of an angle-adjusting device for a treadmill in accordance with the present invention.
Figure 6:
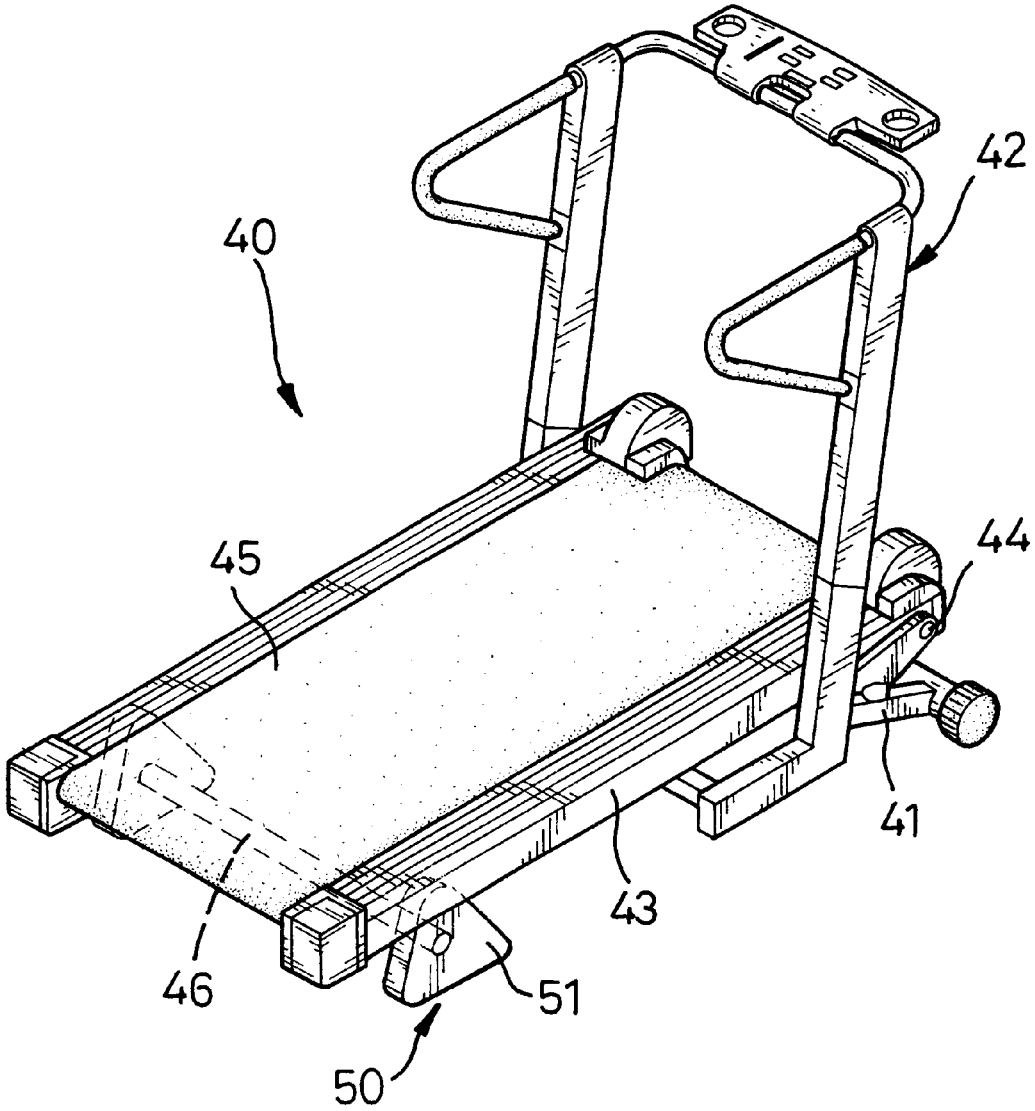
FIG.6 PRIOR ART
FIG. 6 is a perspective view of a treadmill having a conventional angle-adjusting device.

With reference to FIG. 1, an angle-adjusting device for a treadmill in accordance with the present invention comprises a pair of attachment blocks (11), a pair of pins (30) and a pair of polygonal feet (20). One polygonal foot (20) is attached to each attachment block (11) with one of the pins (30). In all other respects, the treadmill (40) as shown in FIG. 6 and further including a front supporting lever (41), an erect handgrip frame (42), a belt frame (43) and a traveling belt (45) is conventional. The belt frame (43, 10) has a front end, a rear end, a top, a bottom and two sides. To avoid unnecessary repetition of known knowledge and techniques, no further description of the treadmill is provided. The polygonal feet (20) are respectively mounted on opposite sides of the bottom near the rear end of the belt frame (10).

The attachment block (11) is adapted to be secured near the rear end under the belt frame (10) of a treadmill and has a transverse through hole (12) defined in the attachment block (11). The polygonal foot (20) consists of two symmetrical polygonal plates (21) and a bridge (23) mounted between and connecting the two polygonal plates (21). Each polygonal plate (21) is made of resilient plastic and has multiple edges (not numbered), and each edge is a different length from the other edges. Further, a pin hole (22) is defined in each polygonal plate (21) to align with the transverse through hole (12) in the attachment block (11). The pin hole (22) is figure-eight shaped and has a first and a second round portion (not numbered) partially overlapping each other. A recess (24) corresponding to the shape of a distal end of the attachment block (11) is defined in the bridge (23) to receive the attachment block (11) inside the recess (24). The pin (30) penetrates the pin holes (22) in the polygonal plates and the transverse through hole (12) in the attachment block (11) to attach the polygonal foot (20) to the belt frame (10). The first round portion of the pin hole (22) is defined in an outer portion of the polygonal plate (21) and provides a releasing space for the pin (30) to remove the attachment block (11). Additionally, a connecting rod (not shown) pivotally extends between the two polygonal feet (20) to make them rotated synchronously.

Figure 2:
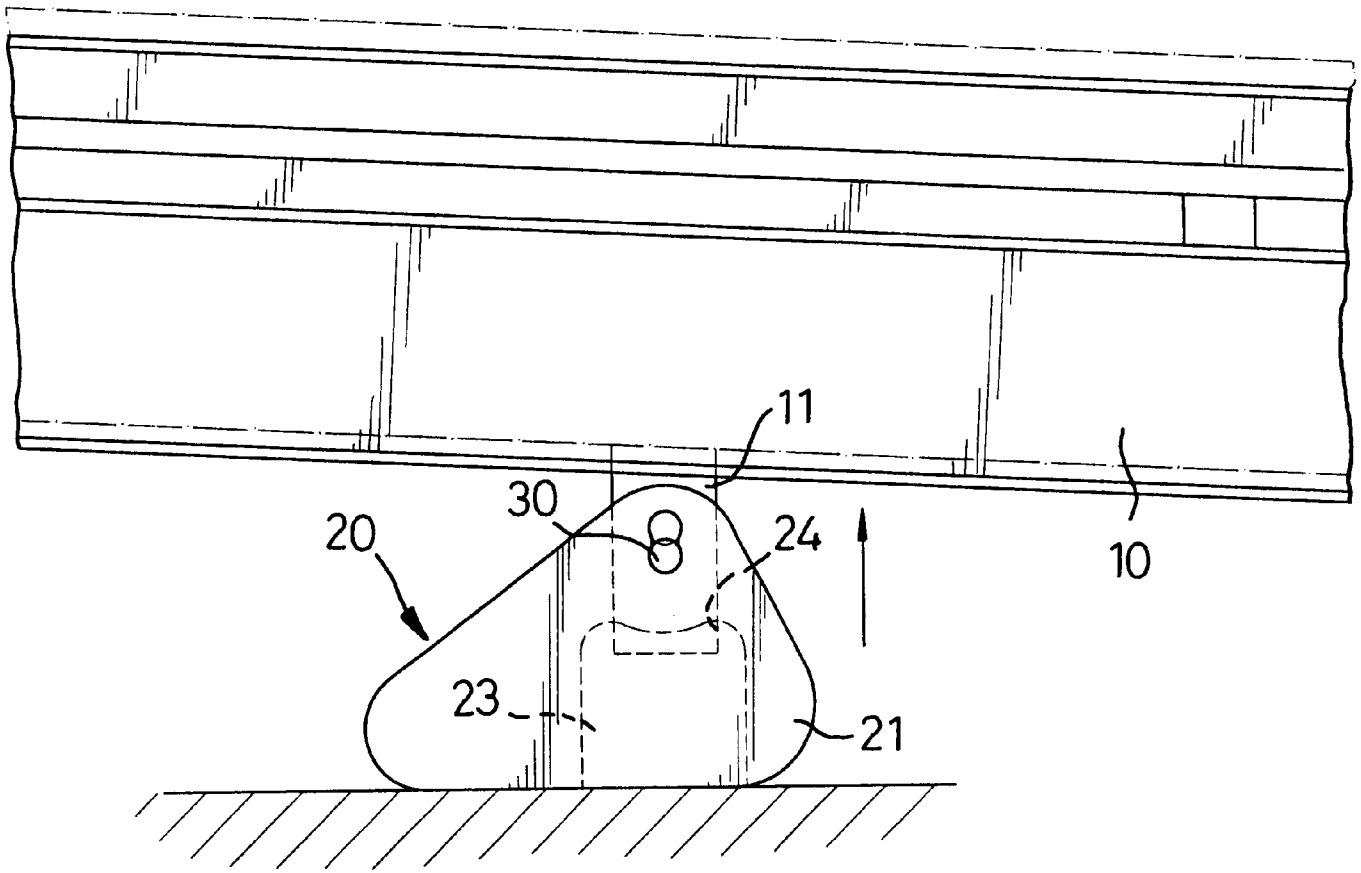
FIG. 2 is an operational cross-sectional side plan view of the angle-adjusting device in FIG. 1.

With reference to FIG. 2, when the angle-adjusting device is used, the polygonal foot (20) is moved toward the attachment block (11) until the first round portion of the pin hole (22) is aligned with the transverse through hole (12) of the attachment block (11). Then, the pin (30) penetrates through the holes (22, 12) to attach the polygonal foot (20) to the belt frame (10). The pin (30) engaging the attachment block (11) is wedged to transplace from the first round position to the second round position when the foot (20) is moved toward the attachment block (11), such that the pin (30) is held inside the second round position. At the same time, the distal end of the attachment block (11) is wedged and completely received inside the recess (24) to construct a rock-steady junction between the polygonal foot (20) and the belt frame (10).

Figure 3:
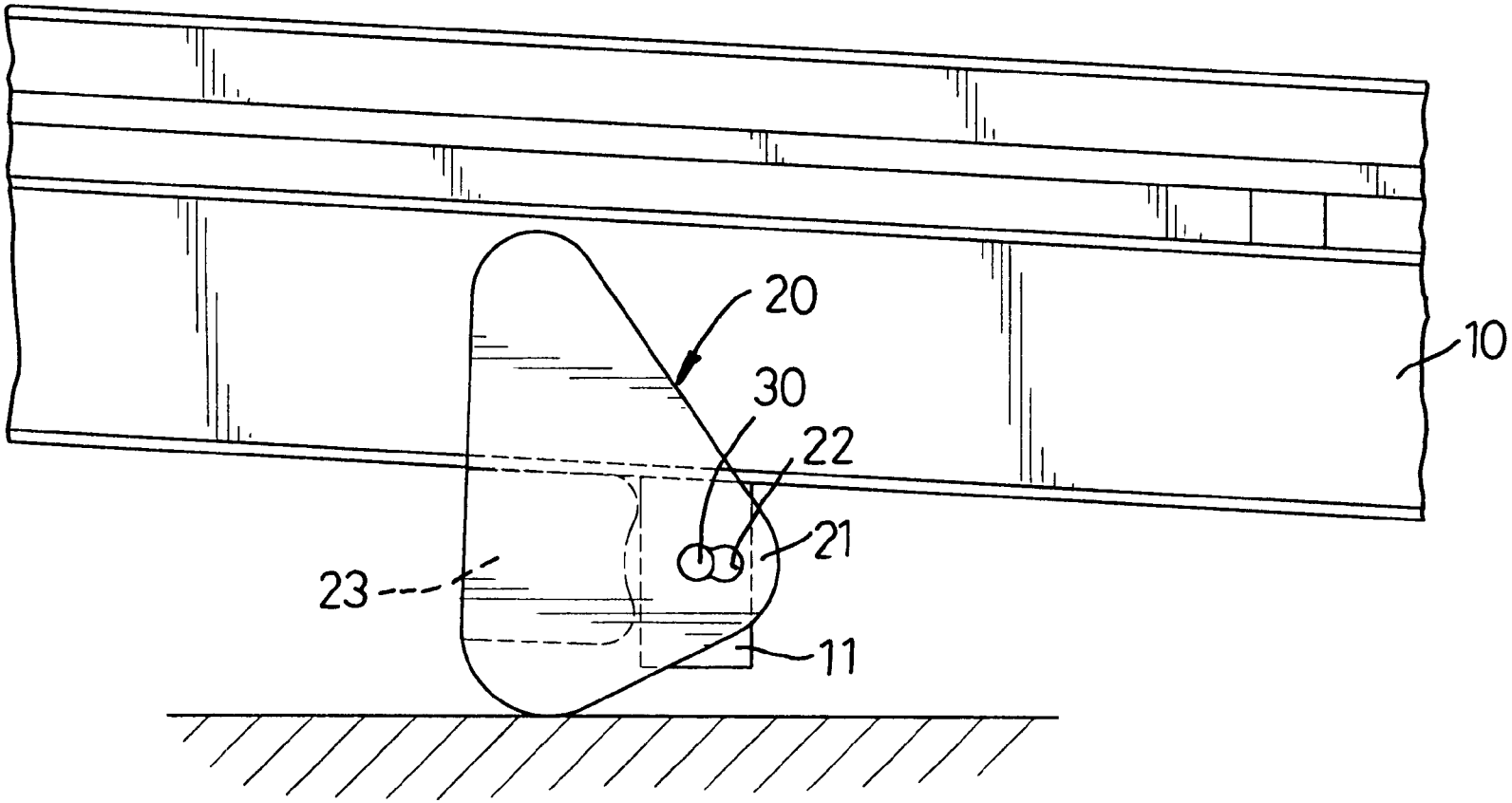
FIG. 3 is another operational cross-sectional side plan view of the angle-adjusting device in FIG. 1.
Figure 4:
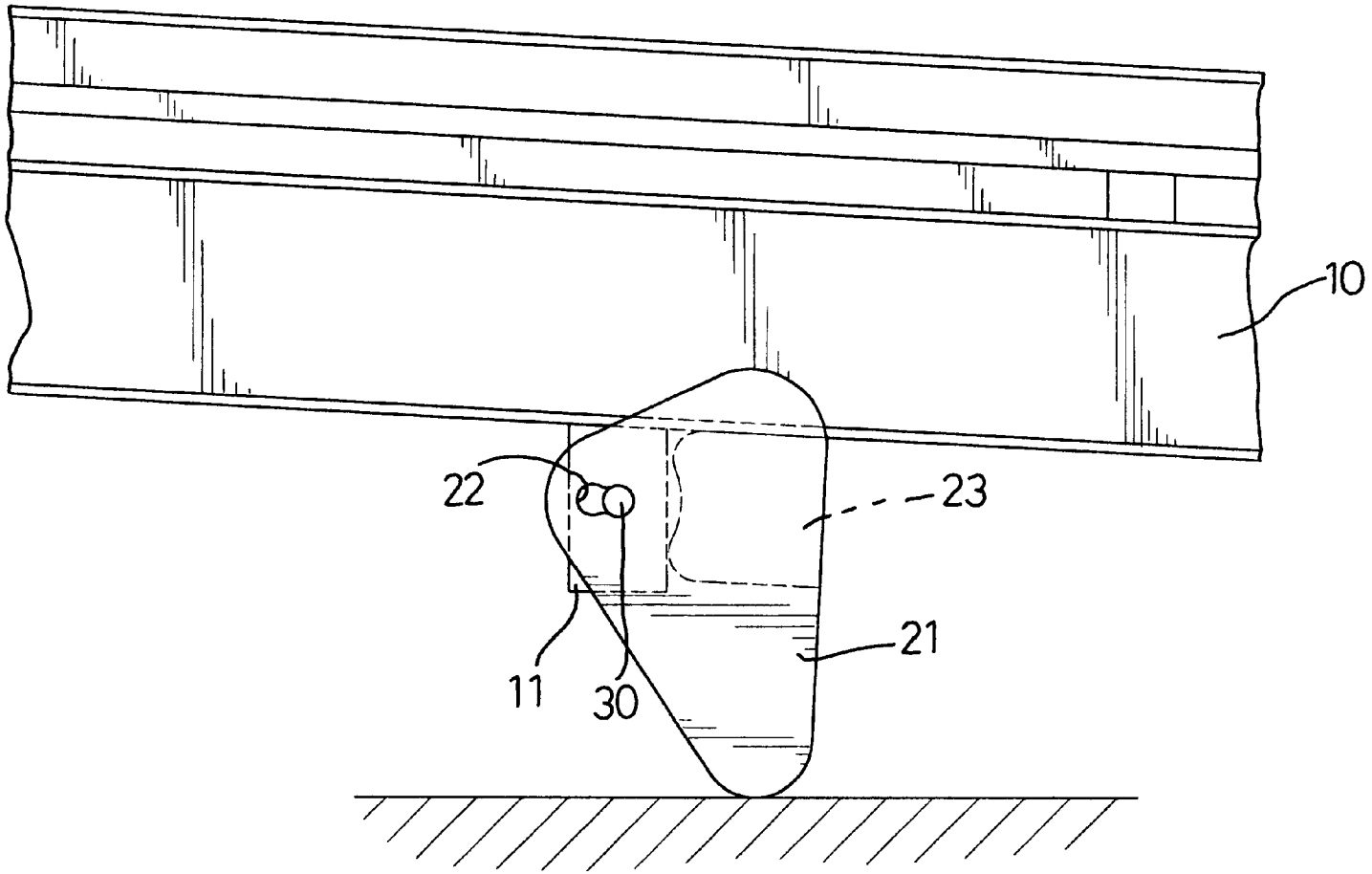
FIG. 4 is a still another operational cross-sectional side plan view of the angle-adjusting device in FIG. 1.

With reference to FIGS. 3 and 4, when the polygonal foot (20) is pulled away from the attachment block (11), the pin (30) will be forced to move from the second round portion back to the first round portion of the pin hole (22). Then, the distal end of the attachment block (11) is withdraw from the recess (24), and the attachment block (11) is separated from the bridge (23). Consequently, the polygonal foot (20) is rotated to make a different parts of the edges contact the ground to change the height of the angle-adjusting device and the inclination of the belt frame (10). The attachment block (11) is held between the pair of polygonal plates (21) and presses against the side edges of the bridge (23). Hereafter, the pin (30) is moved to the second round portion of the pin hole (22) to tightly hold the attachment block (11) against the bridge (23).

Based on the foregoing description, it is easily understood that because the belt frame (10) is firmly combined with the polygonal foot (20), the "linkage" between the belt frame (10) and the polygonal foot (20) is not rotatable or movable. Thus, the kinematic chain of the treadmill when this invention is used is a ternary link that is a locked chain having no movement.

Figure 5:
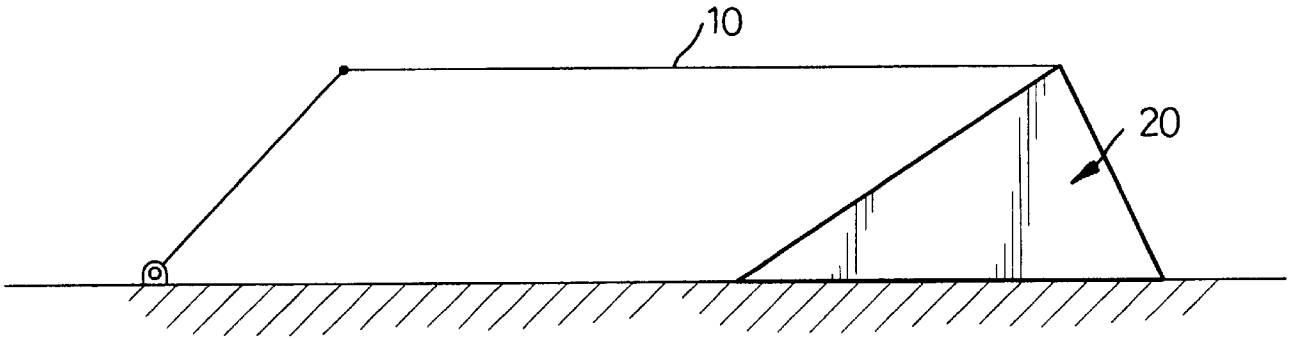
FIG. 5 is a schematic diagram of a mechanic linkage wherein the angle-adjusting device in FIG. 1 is used as an element of the mechanic linkage.
Figure 7:
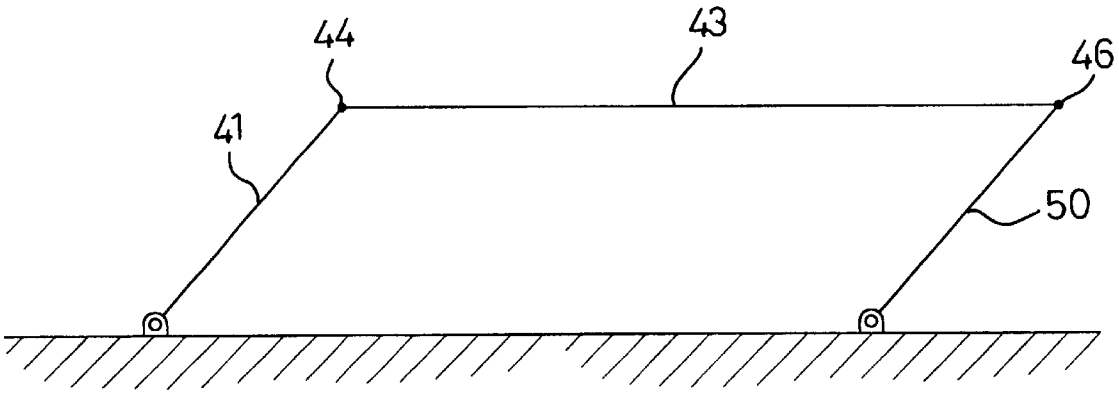
FIG.7 PRIOR ART
FIG. 7 is a schematic diagram of the mechanic linkage of the treadmill in FIG. 6, wherein the conventional angle-adjusting device is used as an element in the mechanical linkage.

With reference to FIG. 5, when the Kutzbach formula is used again, N=3 and P=3 for the ternary link of the treadmill when the angle-adjusting device in accordance with the present invention is used, and F is 0. When F=0 in the Kutzbach formula, the system being analyzed is exactly constrained. Therefore, the system with the ternary link is more stable than the quaternary link of the conventional angle-adjusting device.

Although the invention has been explained relative to its preferred embodiment, it is to be understood that many other possible modifications and variations can be made without departing from the spirit and scope of the invention as hereinafter claimed.

What is claimed is:

1. An angle-adjusting device adapted to be mounted under a belt frame of a treadmill, and comprising:

a pair of attachment blocks adapted to be firmly and respectively attached to two side under the belt frame, and each attachment block has a transverse opening therein;

a pair of polygonal feet operationally attached respectively to one corresponding attachment block, and each polygonal foot including, two symmetrical polygonal plates, each having multiple edges with different lengths and a pin opening defined in each polygonal plate to correspond to the transverse opening of the pair of attachment blocks, wherein the pin opening is figure-eight shaped and has a first and a second round portion partially overlapping each other, a pin moveably penetrating the pin opening in the two symmetrical polygonal plates and extending through the transverse opening in the pair attachment blocks to operationally connect the pair of polygonal feet to the pair of attachment blocks, a bridge between and connecting said two polygonal plates below the pin openings, wherein, each of the attachment blocks is mounted between the respective said two polygonal plates (21); and each attachment block presses against the bridge wherein the corresponding polygonal foot is moved toward the attachment block to make the junction between the belt frame and the polygonal feet steady.

2. The angle-adjusting device as claimed in claim 1, wherein each polygonal plate is made of resilient material.

3. The angle-adjusting device as claimed in claim 1, wherein said bridge further has a recess defined therein to partially receive said attachment block inside the recess.

4. The angle-adjusting device as claimed in claim 1, wherein said pair of polygonal plates is triangular.

5. The angle-adjusting device according to claim 3 wherein said pair of polygonal plates is triangular.

6. The angle-adjusting device according to claim 1 wherein a connecting rod extends between said pair of polygonal feet.

7. The angle-adjusting device according to claim 3 wherein a connecting rod extends between said pair of polygonal feet.

8. The angle-adjusting device according to claim 5 wherein a connecting rod extends between said pair of polygonal feet.

* * * * *